US008833877B2

(12) United States Patent
Elkasevic et al.

(10) Patent No.: US 8,833,877 B2
(45) Date of Patent: Sep. 16, 2014

(54) HINGE ASSEMBLY FOR DOMESTIC APPLIANCE

(75) Inventors: Suad Elkasevic, Winterville, NC (US); George May, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 0 days.

(21) Appl. No.: 13/470,535

(22) Filed: May 14, 2012

(65) Prior Publication Data

US 2013/0300274 A1 Nov. 14, 2013

(51) Int. Cl.

| | |
|---|---|
| ***A47B 88/00*** | (2006.01) |
| ***A47B 95/02*** | (2006.01) |
| ***E05F 1/08*** | (2006.01) |

(52) U.S. Cl.

USPC ..... 312/319.2; 16/286

(58) Field of Classification Search

USPC ..... 312/319.2, 319.3, 327, 328; 16/286; 49/339, 344; 296/56

See application file for complete search history.

(56) References Cited

U.S. PATENT DOCUMENTS

| | | | | |
|---|---|---|---|---|
| 4,345,748 | A * | 8/1982 | Wossner et al. | 267/226 |
| 4,923,182 | A * | 5/1990 | Resuggan | 267/169 |
| 6,397,836 | B1 * | 6/2002 | Pelletier et al. | 126/194 |
| 6,460,839 | B2 * | 10/2002 | Muller | 267/221 |
| 6,634,460 | B1 * | 10/2003 | Hackenberg | 186/59 |
| 6,789,293 | B2 * | 9/2004 | Habegger et al. | 16/343 |
| 7,028,373 | B2 * | 4/2006 | Harmon et al. | 16/284 |
| 2009/0025181 | A1 * | 1/2009 | Burger | 16/286 |
| 2009/0049646 | A1 * | 2/2009 | Rubin et al. | 16/319 |
| 2009/0107783 | A1 * | 4/2009 | Ota | 188/313 |
| 2011/0017191 | A1 * | 1/2011 | White et al. | 126/198 |
| 2011/0101585 | A1 * | 5/2011 | Kamae | 267/226 |
| 2013/0300273 | A1 * | 11/2013 | Elkasevic et al. | 312/327 |

OTHER PUBLICATIONS

Helical Spring Design, Roymech, Jun. 2010, 7 pages.*

* cited by examiner

*Primary Examiner* — Janet M Wilkens
*Assistant Examiner* — Andrew Roersma
(74) *Attorney, Agent, or Firm* — James E. Howard; Andre Pallapies

(57) ABSTRACT

A hinge assembly is provided for pivotably attaching a door to a domestic appliance. The hinge assembly includes a damper cylinder; a rod partially located inside the cylinder and partially located outside the cylinder, the rod having an outer surface and being slidable relative to the cylinder in a reciprocating motion between a fully contracted position and a fully extended position; and a coil spring positioned inside the cylinder and around the rod such that the rod extends through a center of the coil spring, the coil spring having an inner surface and an outer surface. The outer surface of the rod contacts the inner surface of the coil spring to prevent the outer surface of the coil spring from contacting the inside surface of the cylinder.

20 Claims, 3 Drawing Sheets

HINGE ASSEMBLY FOR DOMESTIC APPLIANCE

FIELD OF THE INVENTION

The invention is directed to a hinge assembly for a domestic appliance that reduces or eliminates noise and damage caused by a spring inside a cylinder contacting the internal wall of the cylinder.

An example of an application for the invention is a hinge assembly used with a door of a domestic appliance.

BACKGROUND OF THE INVENTION

Many domestic appliances, such as built in ovens, have one or more doors that swing open about a horizontal axis such that the door swings downward into an open position. Such a door is often heavy and uses springs of significant strength to counteract a portion of the weight of the door so that it is easier for a user to open and close the door. These springs often act to slam the door into the closed position after the door has passed a particular rotational position when moved upward toward the closed position. This slamming is undesirable for at least the reasons that it can make a load noise, it can damage the appliance over time, and it gives the appearance of low quality. The result of such slamming is usually that the user continues to hold the door unit it has reached the closed position.

To prevent the undesirable slamming, soft-close hinges can be employed. Soft-close hinges often include some type of damper that slows the movement of the door for a predetermined distance before the door reaches the closed position. This damping prevent the slamming of the door and results in a much more desirable appliance.

SUMMARY

Some dampers include a spring mounted inside a cylinder. The spring is often very long compared to its diameter in order to fit inside the cylinder. The damper can include a rod that moves relative to the cylinder when the damper is operated. This movement can compress the spring, which can result in the spring moving in a direction perpendicular to the direction of compression. This lateral movement of the spring can result in the outside of the spring contacting the inside wall of the cylinder.

The invention recognizes that contact between the spring and the inside wall of the cylinder can cause noise and can reduce the life of the cylinder, the spring, and other components of the damper. To address the problem of the spring contacting the inside wall of the cylinder, the invention provides a rod that extends through the middle of the spring and supports the spring so that it cannot touch the inside wall of the cylinder.

Particular embodiments of the invention are directed to a hinge assembly for pivotably attaching a door to a domestic appliance. The hinge assembly includes a hinge body configured to attach to the door such that the hinge body is fixed relative to the door; a damper cylinder attached to the hinge body and having an inside surface; a foot attached to the hinge body and the cylinder, the foot being configured to engage a foot receiving portion of the domestic appliance such that the hinge body and the door pivot relative to the domestic appliance; a rod partially located inside the cylinder and partially located outside the cylinder, the rod having an outer surface and being slidable relative to the cylinder in a reciprocating motion between a fully contracted position and a fully extended position; and a coil spring positioned inside the cylinder and around the rod such that the rod extends through a center of a coil of the coil spring, the coil spring having an inner surface that is an inside surface of the coil of the coil spring, and an outer surface that is an outside surface of the coil of the coil spring. The outer surface of the rod contacts the inner surface of the coil spring to prevent the outer surface of the coil spring from contacting the inside surface of the cylinder.

Other embodiments of the invention are directed to a door assembly for pivotably attaching to a domestic appliance. The door assembly includes a door and a hinge assembly. The hinge assembly includes a hinge body attached to the door such that the hinge body is fixed relative to the door; a damper cylinder attached to the hinge body and having an inside surface; a foot attached to the hinge body and the cylinder, the foot being configured to engage a foot receiving portion of the domestic appliance such that the hinge body and the door pivot relative to the domestic appliance; a rod partially located inside the cylinder and partially located outside the cylinder, the rod having an outer surface and being slidable relative to the cylinder in a reciprocating motion between a fully contracted position and a fully extended position; and a coil spring positioned inside the cylinder and around the rod such that the rod extends through a center of a coil of the coil spring, the coil spring having an inner surface that is an inside surface of the coil of the coil spring, and an outer surface that is an outside surface of the coil of the coil spring. The outer surface of the rod contacts the inner surface of the coil spring to prevent the outer surface of the coil spring from contacting the inside surface of the cylinder.

Other embodiments of the invention are directed to a domestic appliance including a domestic appliance body having a foot receiving portion; a door; and a hinge assembly. The hinge assembly includes a hinge body attached to the door such that the hinge body is fixed relative to the door; a damper cylinder attached to the hinge body and having an inside surface; a foot attached to the hinge body and the cylinder, the foot engaging the foot receiving portion of the domestic appliance such that the hinge body and the door pivot relative to the domestic appliance; a rod partially located inside the cylinder and partially located outside the cylinder, the rod having an outer surface and being slidable relative to the cylinder in a reciprocating motion between a fully contracted position and a fully extended position; and a coil spring positioned inside the cylinder and around the rod such that the rod extends through a center of a coil of the coil spring, the coil spring having an inner surface that is an inside surface of the coil of the coil spring, and an outer surface that is an outside surface of the coil of the coil spring. The outer surface of the rod contacts the inner surface of the coil spring to prevent the outer surface of the coil spring from contacting the inside surface of the cylinder.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

Many domestic appliances, such as, for example, built-in ovens, have a door that pivots relative to the body of the appliance to permit access to an internal space of the appliance. These doors are often heavy due to glass view panels, insulation, ventilating structure, and other elements. Springs are often used to reduce the effort needed from the user to close the door. These springs can be strong in order to exert a force that counteracts a large portion of the weight of a heavy door. The result of strong springs is often a slamming of the door once the door passes a particular point in the pivoting.

One or more dampers can be used to damp the closing action resulting from the strong springs to eliminate the slamming that can be caused by undamped springs. The dampers can be any type of damper including, but not limited to, gas filled or liquid filled dampers. Examples of fluid (gas and/or liquid) filled dampers have a cylinder that contains the fluid and may or may not include one or more orifices through with the fluid moves to create the damping force.

Some door hinge assemblies include both a spring and a damper. Some of these door hinge assemblies place the spring inside the damper cylinder to provide a compact assembly.

Figure 1:
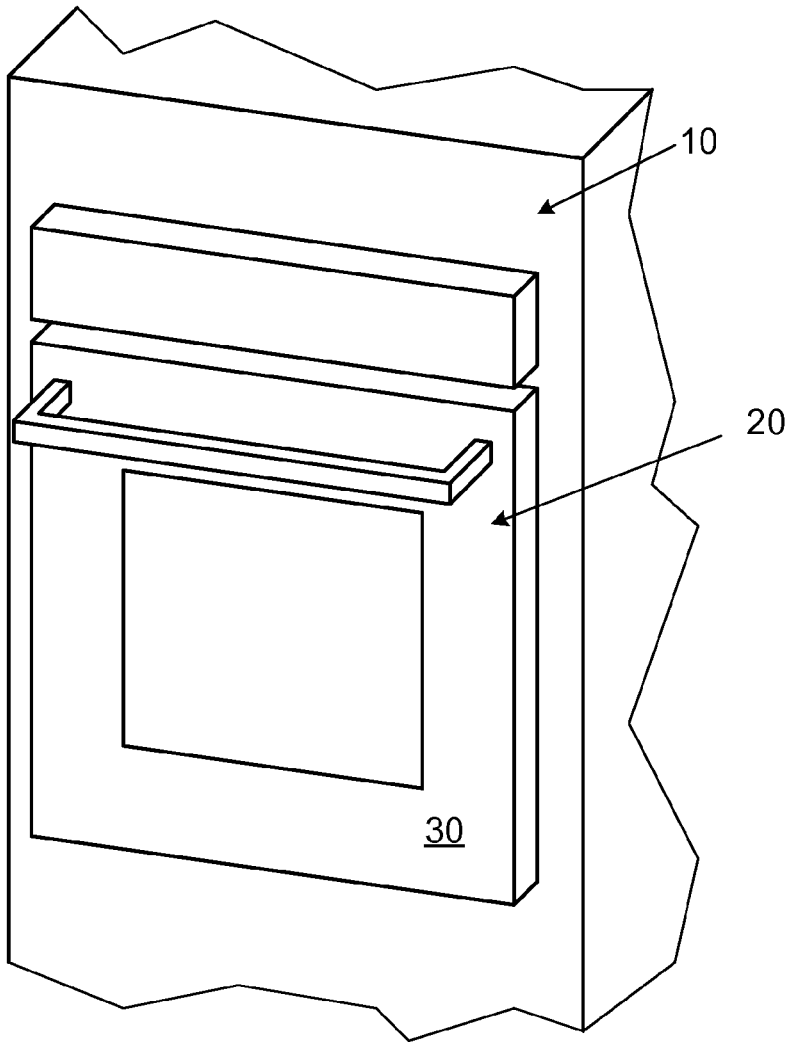
FIG. 1 is a perspective view of a domestic appliance in accordance with exemplary embodiments of the invention.

FIG. 1 shows an example of a domestic appliance 20 mounted in a cabinet 10. An example of a domestic appliance 20 is a cabinet-mounted oven. In this example, domestic appliance 20 includes a door 30 pivotably attached to a body of domestic appliance 20 to selectively open and close an interior space of domestic appliance 20. In some embodiments, door 30 is attached to the body of domestic appliance 20 by two hinge assemblies. Examples of the hinge assemblies are discussed below.

Figure 2:
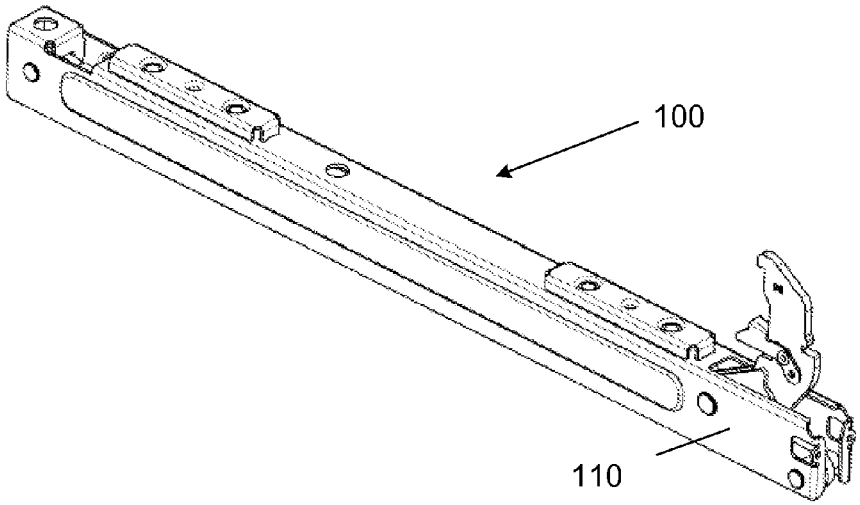
FIG. 2 is a perspective view of a hinge assembly in accordance with exemplary embodiments of the invention.
Figure 3:
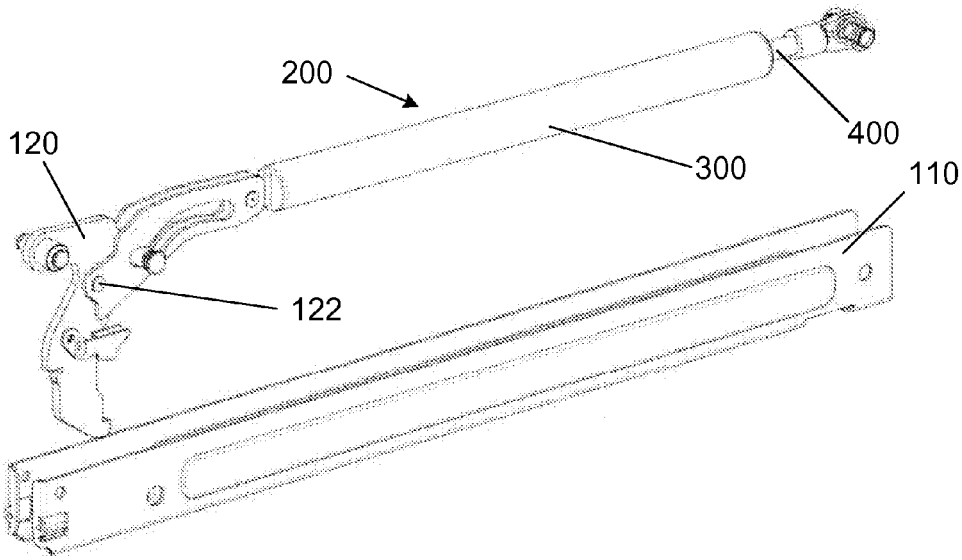
FIG. 3 is a partial exploded view of the hinge assembly shown in FIG. 2.

FIG. 2 shows a perspective view of a hinge assembly 100 that can be used to pivotably attach door 30 to the body of domestic appliance 20. In particular embodiments, two hinge assemblies 100 are used, one on each side of the opening of the interior space of domestic appliance 20. FIG. 3 shows hinge assembly 100 in a partially exploded view. A hinge assembly body 110 partially surrounds an assembly that includes a damper 200 and a foot 120.

Damper 200 includes a cylinder 300 and a rod 400. Rod 400 is partially inside cylinder 300 and partially outside cylinder 300 and moves in a reciprocating motion relative to cylinder 300. A damping force is applied to rod 400 as it moves relative to cylinder 300 and damps the motion of rod 400 relative to cylinder 300. This damping force can result from a fluid inside cylinder 300 being forced through at least one aperture when rod 400 moves, or from some other type of damping mechanism.

In this example, hinge assembly 100 is attached to door 30 such that hinge body 110 does not move relative to door 30. Also shown in FIG. 3 is a foot 120 that is pivotably attached to damper 200 by a pin 122. The lower end of foot 120 in FIG. 3 engages a foot receiving feature on domestic appliance 20 to attach door 30 to domestic appliance 20. Hinge assembly 100 and door 30 are then pivotable relative to the body of domestic appliance 20.

Figure 4:
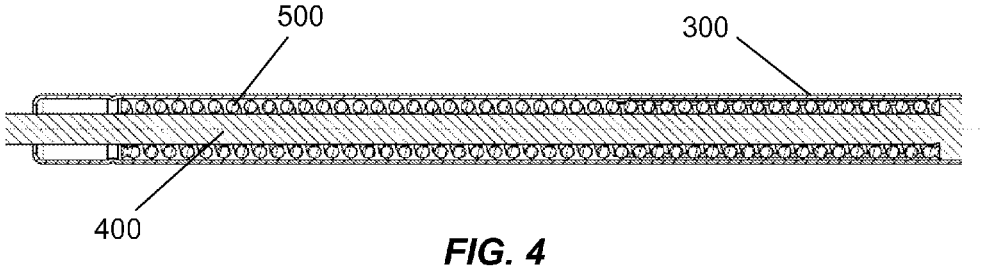
FIG. 4 is a sectional view of a damper in accordance with exemplary embodiments of the invention.
Figure 5:
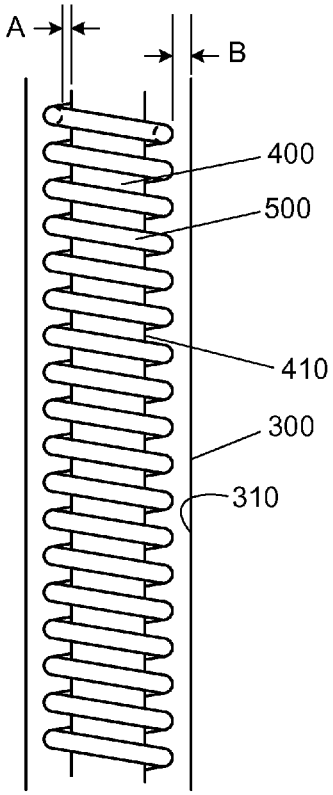
FIG. 5 is a schematic view of a damper in accordance with exemplary embodiments of the invention.
Figure 6:
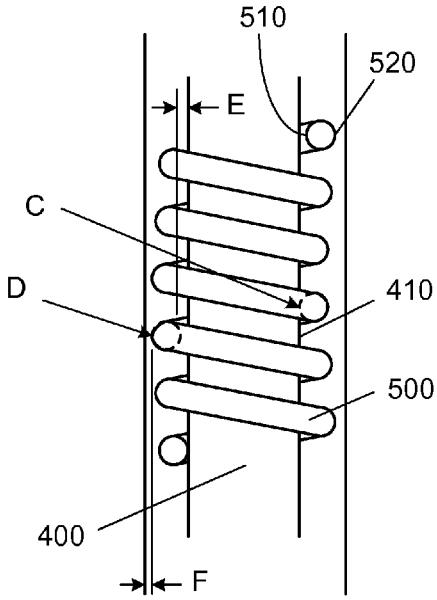
FIG. 6 is a schematic view of a damper in accordance with exemplary embodiments of the invention.

Embodiments of the invention include a coil spring positioned inside cylinder 300 as shown in FIGS. 4-6. FIG. 4 shows rod 400 extending through the center of spring 500 and including a shoulder that supports the right side end of spring 500. As rod 400 is moved to the left in the figure, spring 500 is compressed. This movement corresponds to door 30 being moved from the closed position to the open position. As rod 400 is moved farther to the left, spring 500 becomes increasingly more compressed. When a coil spring having a longitudinal length much longer than its diameter is compressed, it tends to move laterally such that it is no longer straight in the longitudinal direction. When such a coil spring is located in a cylinder, the lateral movement of the spring can cause the spring to contact the inner surface of the cylinder. This contact can cause undesirable noise and can result in the generation of metal shavings and other debris in the cylinder. For example, the spring and/or the inner surface of the cylinder can be worn away due to the contact. The shavings/debris can partially clog damping orifices or otherwise change the damping performance of the damper. Also, the spring characteristics can change due to a loss of material of the spring and due to the friction between the spring and the cylinder wall. These changes are undesirable because they can result in the door no longer having the proper spring force and/or damping force to provide the desired damped closing.

Applicants identified a solution to this problem by providing rod 400 with an outside diameter that supports spring 500 such that the outside of spring 500 cannot come in contact with the inside surface of cylinder 300. In the embodiments shown in FIGS. 4-6, the portion of rod 400 that is inside coil spring 500 has a uniform diameter.

FIG. 4 shows an embodiment in which rod 400 extends through the center of spring 500 such that the inside of spring 500 touches rod 400 along the entire length, or along substantially the entire length, of spring 500 and the outside of spring 500 does not touch the inside of cylinder 300. In this embodiment, spring 500 is supported by the outside of rod 400 at all position of rod 400 including the fully retracted position. The lateral movement of spring 500 discussed above is prevented because the inside of spring 500 contacts the outside of rod 400 and, therefore, contact between the inside of cylinder 300 and the outside of spring 500 is prevented.

FIGS. 5 and 6 show an embodiment of the invention in which the inside of spring 500 does not touch the outside of rod 400 when spring 500 is in an uncompressed position or in a slightly compressed position.

FIG. 5 shows spring 500 in an uncompressed position or in a slightly compressed position. A gap A exists between the inside of spring 500 and an outside surface 410 of rod 400 and a gap B exists between the outside of spring 500 and an inside surface 310 of cylinder 300. This condition can exist when the spring is compressed up to a certain amount depending on the particular spring parameters of the particular spring being used. However, most springs that are appropriate for use in a compact hinge assembly for a domestic appliance will tend to move laterally (as discussed above) at some point when compressed beyond a certain amount.

FIG. 6 shows a partial view of the spring 500 shown in FIG. 5 when spring 500 is compressed to the point where spring 500 moves laterally. FIG. 6 shows at point C that gap A has been reduced to zero such that inside surface 510 of spring 500 comes into contact with outside surface 410 of rod 400. This contact is the result of spring 500 bowing (to the left in FIG. 6) as a result of compression. Because inside surface 510 of spring 500 comes into contact with outside surface 410 of rod 400 at point C, a gap F exists between an outside surface 520 of spring 500 and inside surface 310 of cylinder 300 (see point D). The condition shown in FIG. 6 can exist at one location along spring 500 or at multiple locations. However, by providing a relatively small gap A (for example 3% to 5% of the diameter of spring 500), the condition shown in FIG. 6 can be limited to only one location. Limiting the condition shown in FIG. 6 to only one location can eliminate noise caused by the spring transitioning from a wave form having a single crest to a wave form having multiple crests. Further, by providing only a small gap A between the inside of spring 500 and outside surface 410 of rod 400, even if spring 500 transitions from a wave form having a single crest to a wave form having multiple crests, spring 500 can move laterally only a small amount. This small lateral movement reduces or prevents noise caused by inside surface 510 slamming against outside surface 410 during the wave transition.

In particular embodiments, spring 500 has a diameter of preferably between 0.565" and 0.595", and more preferably between 0.570" and 0.580", and a length preferably between 8.83" and 8.7", and more preferably between 8.84" and 8.86". In particular embodiments, spring 500 has a diameter to length ratio of preferably between 1:15.7 and 1:14.7, and more preferably between 1:15.5 and 1:15.3.

In particular embodiments, gap A is preferably between 0.005" and 0.020", and more preferably between 0.010" and 0.015", and gap B is preferably between 0.035" and 0.050", and more preferably between 0.055" and 0.075".

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the invention.

What is claimed is:

1. A hinge assembly for pivotably attaching a door to a domestic appliance, the hinge assembly comprising:
- a hinge body configured to attach to the door such that the hinge body is fixed relative to the door;
- a damper cylinder attached to the hinge body and having an inside surface;
- a foot attached to the hinge body and the cylinder, the foot being configured to engage a foot receiving portion of the domestic appliance such that the hinge body and the door pivot relative to the domestic appliance;
- a rod partially located inside the cylinder and partially located outside the cylinder, the rod having an outer surface and being slidable relative to the cylinder in a reciprocating motion between a fully contracted position and a fully extended position; and
- a coil spring positioned inside the cylinder and around the rod such that the rod extends through a center of a coil of the coil spring, the coil spring having an inner surface that is an inside surface of the coil of the coil spring, and an outer surface that is an outside surface of the coil of the coil spring,
- wherein the rod has a first portion that is the entire portion of the rod that is inside the coil of the coil spring when the rod is in the fully contracted position,
- the first portion of the rod has a uniform diameter, and
- the outer surface of the rod contacts the inner surface of the coil spring to prevent any portion of the outer surface of the coil spring from contacting the inside surface of the cylinder.

2. The assembly of claim 1, wherein the outer surface of the rod is in contact with the inner surface of the coil spring when the rod is in the fully contracted position.

3. The assembly of claim 2, wherein the outer surface of the rod is in contact with the inner surface of the coil spring when the rod is in the fully extended position.

4. The assembly of claim 1, wherein the coil spring has a length in a longitudinal direction that is perpendicular to an outer diameter of the coil, and the length is longer than the outer diameter of the coil when the rod is in the fully contracted position.

5. The assembly of claim 4, wherein the length is at least five times the outer diameter of the coil.

6. The assembly of claim 1, wherein the damper cylinder contains a fluid.

7. The assembly of claim 6, wherein the fluid is a viscous liquid.

8. The assembly of claim 1, wherein the outer surface of the rod is in contact with the inner surface of the coil spring when the rod is in the fully extended position,
- the coil spring has a length in a longitudinal direction that is perpendicular to an outer diameter of the coil,
- the length is at least five times the outer diameter of the coil, and
- the damper cylinder contains a fluid.

9. A door assembly for pivotably attaching to a domestic appliance, the door assembly comprising:
- a door; and
- a hinge assembly including
  - a hinge body attached to the door such that the hinge body is fixed relative to the door;
  - a damper cylinder attached to the hinge body and having an inside surface;
  - a foot attached to the hinge body and the cylinder, the foot being configured to engage a foot receiving portion of the domestic appliance such that the hinge body and the door pivot relative to the domestic appliance;
  - a rod partially located inside the cylinder and partially located outside the cylinder, the rod having an outer surface and being slidable relative to the cylinder in a reciprocating motion between a fully contracted position and a fully extended position; and
  - a coil spring positioned inside the cylinder and around the rod such that the rod extends through a center of a coil of the coil spring, the coil spring having an inner surface that is an inside surface of the coil of the coil spring, and an outer surface that is an outside surface of the coil of the coil spring,
- wherein the rod has a first portion that is the entire portion of the rod that is inside the coil of the coil spring when the rod is in the fully contracted position,
- the first portion of the rod has a uniform diameter, and
- the outer surface of the rod contacts the inner surface of the coil spring to prevent any portion of the outer surface of the coil spring from contacting the inside surface of the cylinder.

10. The assembly of claim 9, wherein the outer surface of the rod is in contact with the inner surface of the coil spring when the rod is in the fully contracted position.

11. The assembly of claim 10, wherein the outer surface of the rod is in contact with the inner surface of the coil spring when the rod is in the fully extended position.

12. The assembly of claim 9, wherein the coil spring has a length in a longitudinal direction that is perpendicular to an outer diameter of the coil, and the length is at least five times the outer diameter of the coil when the rod is in the fully contracted position.

13. The assembly of claim 9, wherein the damper cylinder contains a fluid.

14. The assembly of claim 13, wherein the fluid is a viscous liquid.

15. The assembly of claim 9, wherein the outer surface of the rod is in contact with the inner surface of the coil spring when the rod is in the fully extended position, the coil spring has a length in a longitudinal direction that is perpendicular to an outer diameter of the coil, the length is at least five times the outer diameter of the coil when the rod is in the fully contracted position, and the damper cylinder contains a fluid.

16. A domestic appliance, comprising:

a domestic appliance body having a foot receiving portion;

a door; and a hinge assembly including a hinge body attached to the door such that the hinge body is fixed relative to the door;

a damper cylinder attached to the hinge body and having an inside surface;

a foot attached to the hinge body and the cylinder, the foot engaging the foot receiving portion of the domestic appliance such that the hinge body and the door pivot relative to the domestic appliance;

a rod partially located inside the cylinder and partially located outside the cylinder, the rod having an outer surface and being slidable relative to the cylinder in a reciprocating motion between a fully contracted position and a fully extended position; and a coil spring positioned inside the cylinder and around the rod such that the rod extends through a center of a coil of the coil spring, the coil spring having an inner surface that is an inside surface of the coil of the coil spring, and an outer surface that is an outside surface of the coil of the coil spring, wherein the rod has a first portion that is the entire portion of the rod that is inside the coil of the coil spring when the rod is in the fully contracted position, the first portion of the rod has a uniform diameter, and the outer surface of the rod contacts the inner surface of the coil spring to prevent any portion of the outer surface of the coil spring from contacting the inside surface of the cylinder.

17. The domestic appliance of claim 16, wherein the outer surface of the rod is in contact with the inner surface of the coil spring when the rod is in the fully contracted position.

18. The domestic appliance of claim 17, wherein the outer surface of the rod is in contact with the inner surface of the coil spring when the rod is in the fully extended position.

19. The domestic appliance of claim 16, wherein the coil spring has a length in a longitudinal direction that is perpendicular to an outer diameter of the coil, and the length is at least five times the outer diameter of the coil when the rod is in the fully contracted position.

20. The domestic appliance of claim 16, wherein the damper cylinder contains a fluid.

* * * * *